US007102581B1

(12) United States Patent
West

(10) Patent No.: US 7,102,581 B1
(45) Date of Patent: Sep. 5, 2006

(54) MULTIBAND WAVEGUIDE REFLECTOR ANTENNA FEED

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 20 days.

(21) Appl. No.: 10/882,976

(22) Filed: Jul. 1, 2004

(51) Int. Cl.
*H01Q 3/00* (2006.01)
*H01P 1/16* (2006.01)

(52) U.S. Cl. ..... 343/762; 333/21 R

(58) Field of Classification Search ..... 343/840, 343/762, 764, 772, 775, 786, 787; 333/21 A, 333/21 R, 107, 114, 115, 206, 248
See application file for complete search history.

(56) References Cited

U.S. PATENT DOCUMENTS 5,638,944 A * 6/1997 Diebel et al. ..... 200/43.03
5,907,797 A * 5/1999 Hanatatsu et al. ..... 455/115.2
6,323,819 B1 * 11/2001 Ergene ..... 343/786
6,720,932 B1 * 4/2004 Flynn et al. ..... 343/786

OTHER PUBLICATIONS

Marcuvitz, N. *Waveguide Handbook,* Peter Peregrines, Ltd., London, UK, 1986, pp. 66, 71, 72, and 79.

Kildal, P. S. et al. "Artificially Soft and Hard Surfaces in Electromagnetics and Their Applications", *IEEE Antennas and Propagation Society International Symposium AP_S Digest,* Jun. 1986, pp. 832-835.

Kildal, P.S., "Relationship Between Surface Impedance and Bandwidth of Hard Surface", *IEEE Antennas and Propagation Society International Symposium AP_S Digest,* Mar. 1994, pp. 1460-1463.

* cited by examiner

*Primary Examiner*—Shih-Chao Chen
*Assistant Examiner*—Minh Dieu A
(74) *Attorney, Agent, or Firm*—Nathan O. Jensen; Kyle Eppele

(57) ABSTRACT

A multiband waveguide reflector antenna feed comprises waveguide feeds in a concentric architecture. A waveguide feed is located in the center and coaxial waveguide feeds are disposed around the center feed. The waveguide feeds may be all-metallic with the center feed operating in a $TE_{11}$ mode and the coaxial feeds operating in a coaxial $TE_{11}$ mode. The waveguide feeds may have electromagnetic band gap (EBG) surfaces on waveguide surfaces. The center waveguide feed may have an EBG outer conductor surface and operate in a circular waveguide TEM mode. The coaxial waveguide feeds may have EBG inner and outer conductors and operate in a circular waveguide TEM mode. The coaxial feeds may have EBG inner conductors and near perfect electrical conductor (PEC) outer conductors and operate in a circular waveguide-like $TE_{11}$ mode or may comprise EBG outer conductors and PEC inner conductors and operate in a quasi-TEM waveguide mode.

19 Claims, 5 Drawing Sheets

MULTIBAND WAVEGUIDE REFLECTOR ANTENNA FEED

BACKGROUND OF THE INVENTION

This invention relates to antennas, reflector antennas, and specifically to a multiband waveguide reflector antenna feed.

Contemporary military satellite communication (SATCOM) systems require cost-effective, light-weight, low-mass, multiband and polarization-agile antenna apertures. Specific SATCOM bands of current interest include C-band, X-band, Ku-band (10.7–12.7 GHz), K-band (20–22 and 29–31 GHz) and Q-band (43–45 GHz) for various military and commercial SATCOM systems. In addition, the ability to receive orthogonal polarized signals within the same band is a requirement for military SATCOM systems. An example of this is the requirement to simultaneously receive SCAMP MILSTAR (21-GHz right-hand circular polarization (RHCP)) and Global Broadcast System (GBS) video link (21-GHz left-hand circular polarization (LHCP)).

A traditional metallic waveguide feed 15 for a reflector antenna 10 is illustrated in FIG. 1 and represents the current art in reflector systems for portable communications. With the traditional waveguide feed 15 the realization of more than two bands is difficult. Multiband feeds can be mechanically large and therefore initiate excessive aperture blockage for many reflector applications. The feed assemblies are mechanically complex and difficult to manufacture, which adds to weight and cost. Such feeds are capable of circular polarization only and limited to two frequency bands.

Cluster feeds are commonly used on large satellite reflectors. They are mechanically complex and are not suitable for moderate and small-sized reflectors due to large aperture blockage.

A need exists for a low-cost, physically compact multiband reflector antenna feed for multiband polarization-agile communications-on-the-move and other microwave/millimeter wave multiband SATCOM systems.

SUMMARY OF THE INVENTION

A multiband waveguide reflector antenna feed is disclosed. The multiband waveguide reflector antenna feed comprises a plurality of circular waveguide feeds disposed in a concentric architecture. The plurality of waveguide feeds include a band 1 waveguide feed disposed in the center of the multiband waveguide reflector antenna feed. A band 2 waveguide feed is disposed in a concentric ring around the band 1 waveguide feed and operates as a coaxial waveguide with the band 1 waveguide feed outer surface as an inner conductor. A band 3 waveguide feed is disposed in a concentric ring around the band 2 waveguide feed and operates as a coaxial waveguide with the band 2 waveguide feed outer surface as an inner conductor. A band 4 waveguide feed is disposed in a concentric around the band 3 waveguide feed and operates as a coaxial waveguide feed with the band 3 waveguide feed outer surface as an inner conductor.

In one embodiment of the multiband waveguide reflector antenna feed the plurality of circular waveguide feeds comprise all-metallic waveguides. The all-metallic waveguides comprise perfect electrical conductor (PEC) surfaces. In the all-metallic waveguide embodiment the band 1 waveguide feed operates in a $TE_{11}$ mode and the band 2, 3, and 4 waveguide feeds operate in a coaxial $TE_{11}$ mode.

In another embodiment of the multiband waveguide reflector antenna feed one or more of the plurality of circular waveguide feeds may have electromagnetic band gap (EBG) surfaces on inner conductor and outer conductor waveguide surfaces. The band 1 waveguide feed comprises an EBG outer conductor waveguide surface and operates in a circular waveguide TEM mode. The band 2 waveguide feed, the band 3 waveguide feed, and the band 4 waveguide feed may comprise EBG inner conductors and outer conductors and operate in a circular waveguide TEM mode. The band 2 waveguide feed, the band 3 waveguide feed, or the band 4 waveguide feed may comprise EBG inner conductors and PEC outer conductors and operate in a circular waveguide-like $TE_{11}$ mode. The band 2 waveguide feed, the band 3 waveguide feed, or the band 4 waveguide feed may comprise EBG outer conductors and PEC inner conductors and operate in a quasi-TEM waveguide mode.

It is an object of the preset invention to provide a low-cost, physically compact multiband waveguide reflector antenna feed for multiband polarization-agile communications-on-the-move and other microwave/millimeter wave multiband SATCOM systems.

It is an object of the present invention to provide a multiband waveguide reflector antenna feed that has a small cross-sectional area to minimize aperture blocking.

It is an advantage of the present invention to provide multiple bands at a common phase center.

It is an advantage of the present invention to provide the ability to mix and match modes across concentric ring sections.

It is an advantage of the present invention to provide linear polarization, arbitrarily oriented linear polarization, or circular polarization in a given concentric ring section.

It is a feature of the present invention to provide simultaneous right-hand circular polarization and left-hand circular polarization for each band possible.

It is a feature of the present invention to provide dual-band operation with perfect electrical conductor and on-band electromagnetic band gap structures in a waveguide feed section.

BRIEF DESCRIPTION OF THE DRAWINGS

The invention may be more fully understood by reading the following description of the preferred embodiments of the invention in conjunction with the appended drawings wherein.

DETAILED DESCRIPTION

The present invention is for a high-efficiency, multiband, polarization-agile waveguide feed for prime focus, Cassegrain, Gregorian, offset reflector and multiple reflector antennas.

Figure 1:
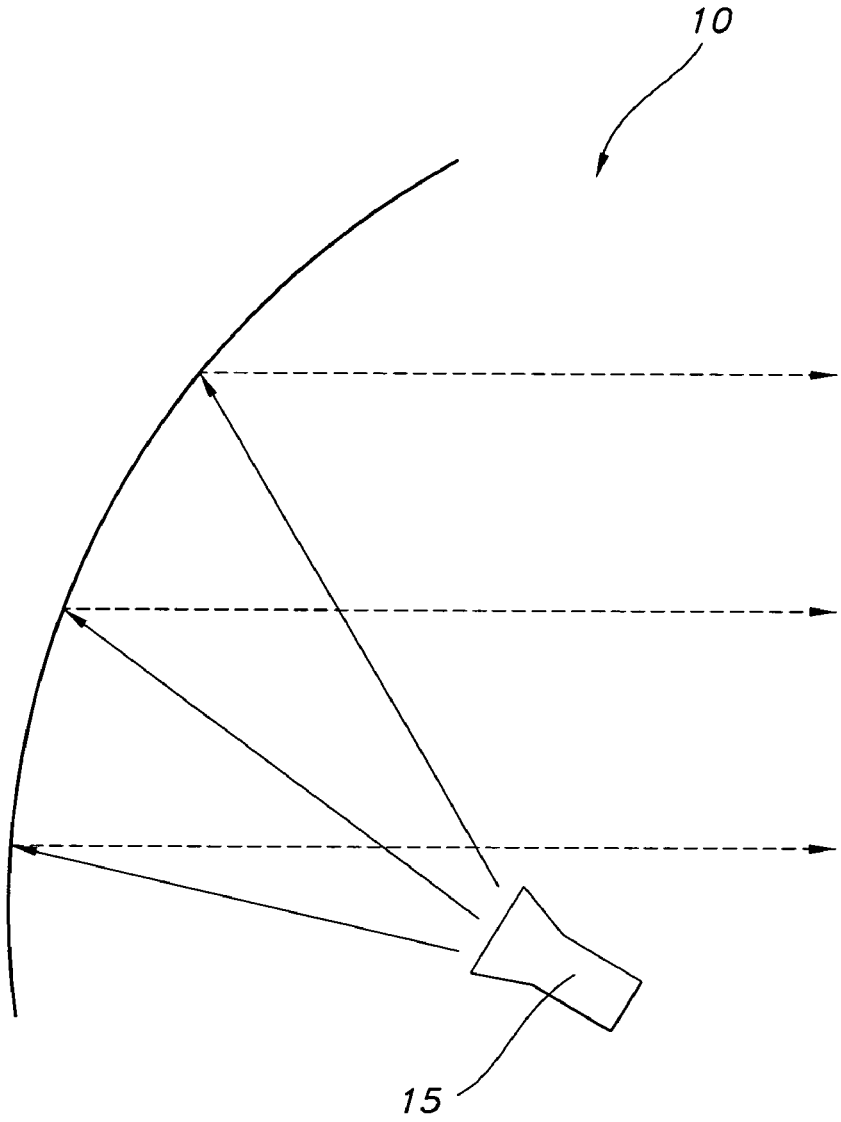
FIG. 1 (PRIOR ART)
FIG. 1 is a diagram of a traditional metallic waveguide feed for a reflector antenna and represents the current art in reflector systems for portable communications.
Figure 2:
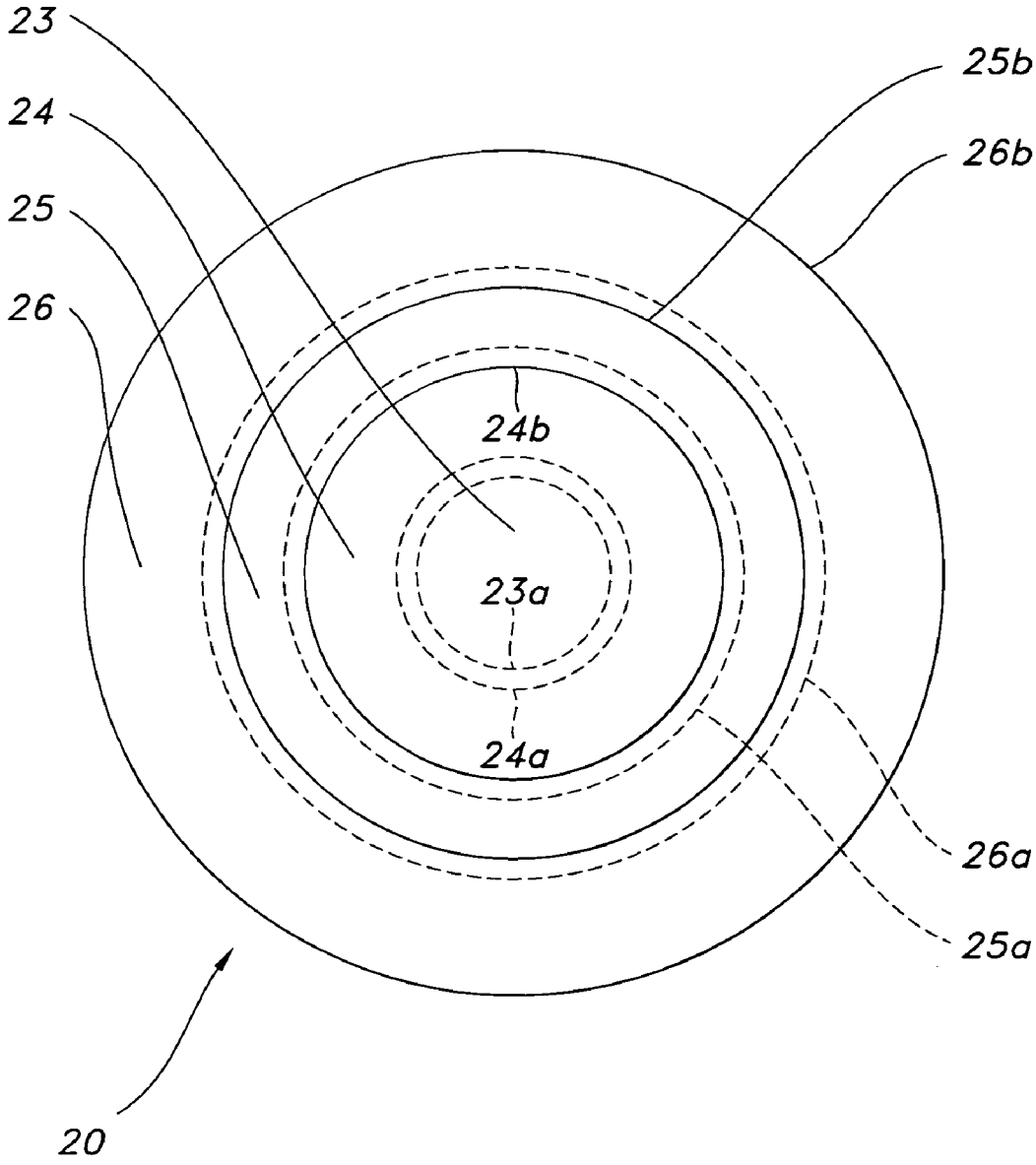
FIG. 2 is a front view of a multiband waveguide reflector antenna feed of the present invention.
Figure 3:
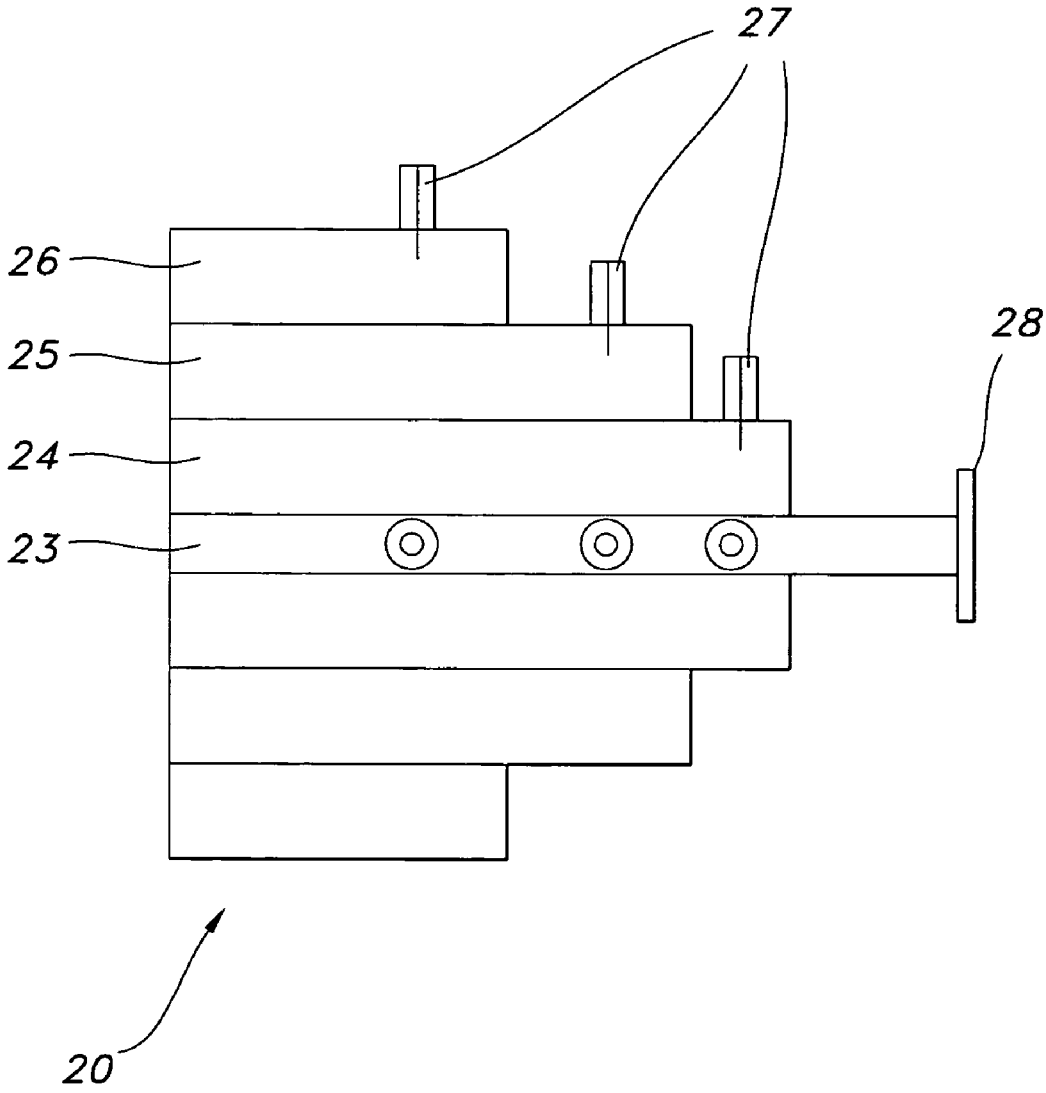
FIG. 3 in a side view of the multiband waveguide reflector antenna feed of the present invention.

A multiband waveguide reflector antenna feed 20 of the present invention is shown in FIG. 2 in a front view and FIG. 3 in a side view. In FIGS. 2 and 3 four waveguide feeds of the multiband waveguide reflector antenna feed 20 are shown in a concentric architecture utilizing circular waveguides. Other numbers of feeds may be incorporated in the multiband waveguide feed 20 of the present invention by adding or deleting circular waveguides. A band 1 waveguide feed 23 is disposed in the center of the multiband waveguide feed 20 and has an outer conductor 23*a*. A band 2 waveguide feed 24 is the next concentric ring outward from the band 1 waveguide feed 23 and operates as a coaxial waveguide with an outer conductor 24*b* and the band 1 waveguide feed 23 outer surface as its inner conductor 24*a*. A band 3 waveguide feed 25 is the next concentric ring outward from the band 2 waveguide feed 24 and operates as a coaxial waveguide with an outer conductor 25*b* and the band 2 waveguide feed 24 outer surface as its inner conductor 25*a*. A band 4 waveguide feed 26 is the outer ring in FIG. 2 and operates as a coaxial waveguide feed with an outer conductor 26*b* and the band 3 waveguide feed 25 outer surface as its inner conductor 26*a*.

A waveguide input 28 in FIG. 3 is used to feed the band 1 waveguide feed 23 and waveguide-to-coax transitions 27 may be used to feed the band 2 waveguide feed 24, the band 3 waveguide feed 25, and the band 4 waveguide feed 26. An alternate embodiment is to utilize impedance matched waveguide sections as input ports for band 2, 3, and 4.

The multiband waveguide feed architecture 20 can be realized either by an all-metallic coaxial waveguide structure that approximates a perfect electrical conductor (PEC), as an electromagnetic band gap (EBG) structure that approximates a perfect magnetic conductor (PMC), or as a combination of the two across the various bands. Prefect electrical conductor and prefect magnetic conductor are used for discussion purposes only with the understanding that such devices can only be approximated. In FIG. 2, metallic perfect electrical conductors (PEC) are illustrated as solid concentric rings 24*b*, 25*b*, and 26*b* while EBG structures (PMC) are illustrated as dashed concentric rings 23*a*, 24*a*, 25*a*, and 26*a*.

EBG materials are periodic surfaces that become a high impedance open circuit to incident waves at a resonant frequency. The surface impedance of a given EBG physical embodiment is a function of frequency. When waveguide structures are lined with EBG materials, the waveguide propagation characteristics change as a function of the surface impedance. The EBG substrate material may be GaAs, ferroelectric, ferromagnetic, or any suitable EBG flexible printed circuit embodiment. An electromagnetic hard EBG surface may also be realized by air filled or dielectric filled axial corrugations on the conductor surfaces of the waveguides.

The first embodiment of the present invention is an all-metallic coaxial waveguide structure 20 consisting of a highest frequency $TE_{11}$ waveguide structure, which is the band 1 waveguide 23 of FIGS. 2 and 3 surrounded by concentric rings of $TE_{11}$ coaxial waveguide sections for the remaining lower band frequencies, band 2 waveguide 24, band 3 waveguide 25, and band 4 waveguide 26. In the all-metallic coaxial waveguide 20, the EBG structures shown as dashed concentric rings 23*a*, 24*a*, 25*a*, and 26*a* in FIG. 2 are to be considered as solid rings for the purposes of the all-metallic feed embodiment discussion.

Figure 4:
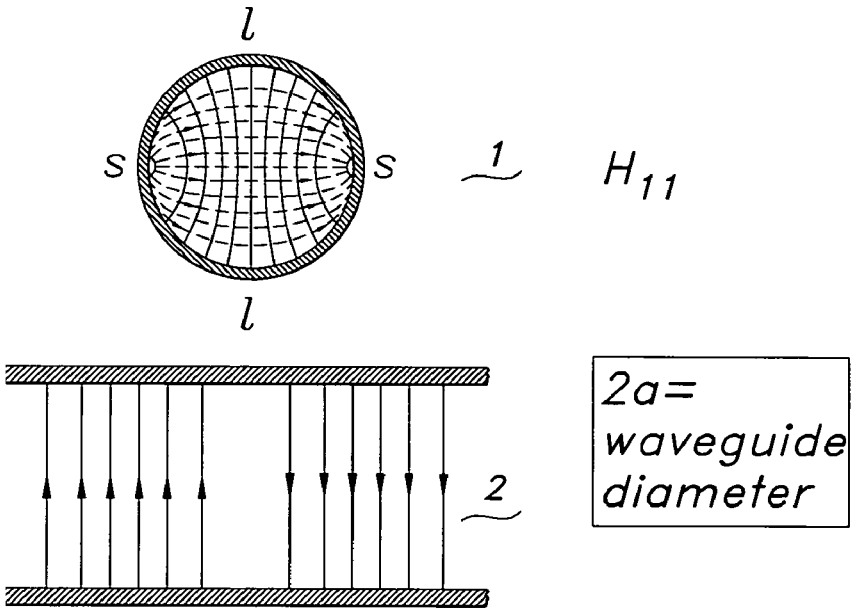
FIG. 4 shows standard circular waveguide $TE_{11}$ mode operation.

At the highest frequency, the band 1 center waveguide section 23 operates in the standard $TE_{11}$ mode shown in FIG. 4. The cutoff frequency for the $TE_{11}$ mode is commonly known in the art as:

$$f_{cTe11} = \frac{2c}{1.640a} \qquad \text{Equation 1}$$

where, c=the speed of light, and a=the waveguide radius.

The radius of the band 1 waveguide center section 23 is typically selected with regard to minimum insertion loss, maximum separation of out-of-band spurious circular waveguide modes, and desired radiation pattern characteristics. The remaining frequency band waveguide sections 24, 25, and 26 are implemented in coaxial $TE_{11}$ mode configurations.

Figure 5:
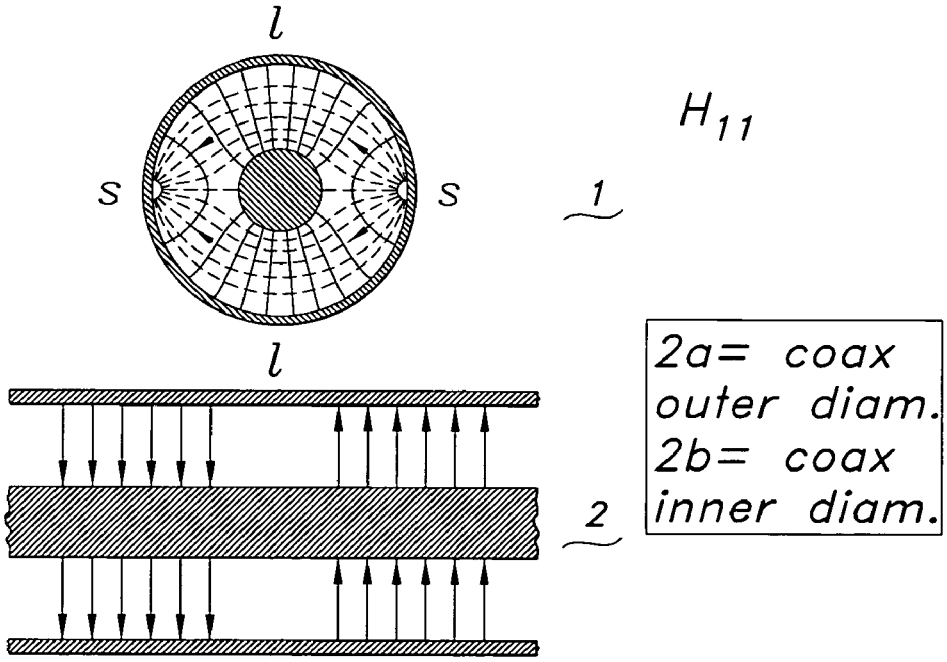
FIG. 5 shows higher ordered metallic coaxial waveguide $TE_{11}$ mode operation.

The fundamental mode of the all-metallic coaxial waveguide structure 20 is the transverse electromagnetic (TEM), which is deliberately not excited in this application. A TEM mode suppressor device can be implemented if required. The band 2 waveguide 24 higher ordered metallic coaxial waveguide mode is again a $TE_{11}$ mode. This mode is depicted in FIG. 5. The cutoff frequency for this mode is commonly known to be:

$$f_{cCoaxTe11} = \frac{2c}{1.873\pi(b+a)} \qquad \text{Equation 2}$$

where, c=the speed of light, a=the coax outer radius, and b=the coax inner radius (formulation assumes a=3b).

Similar expressions can be derived for different a/b ratios. In addition, cutoff frequencies can be readily predicted with contemporary electromagnetic (EM) computer simulations tools.

It is commonly known that circular polarization can be realized by superposition of two $TE_{11}$ spatially orthogonal modes shifted in phase by 90°, for both circular waveguide and the coaxial waveguide cross sections. It is possible to realize dual orthogonal linear polarization, right hand circularly polarized (RHCP) and left hand circularly polarized (LHCP), and arbitrarily orientated linear polarization with an appropriate phasing network (not shown).

One representative set of dimensions to cover multiband operation in the all-metallic embodiment is illustrated in Table 1 below. This analysis is based solely on mode considerations for a coaxial a/b ratio of 1.5. Optimal feed radiation patterns for reflector illumination is not considered in this analysis.

It can be readily seen that each coaxial section's operating bandwidth is well above cutoff. Similar modal analysis was performed for TM and higher TE modes. These modes can operate within the respective bands, but it is apparent upon examination of the field structure that these modes are difficult to excite and sustain. It is also possible to dielectrically load the waveguide as a design parameter to adjust the aperture size for radiation performance.

TABLE 1

$TE_{11}$ Waveguide modes for the All-Metallic Embodiment

| Freq. Band, GHz | "b", in. | "a", in. | $TE_{11}$ mode cut off, GHz | $f_o/f_{co}$ |
|---|---|---|---|---|
| 43–45 | N/A | 0.275 | 12.66, circular waveguide | 3.5 |
| 29–31 | 0.275 | 0.4125 | 5.5, coax | 5.45 |
| 19–21 | 0.4125 | 0.6188 | 3.66, coax | 5.47 |
| 10–12 | 0.6188 | 1.2375 | 2.44, coax | 4.5 |

The second embodiment of the present invention utilizes EBG or PMC surfaces, also known as hard surfaces, for waveguide surfaces conductors as shown by the dashed rings 23*a*, 24*a*, 25*a*, and 26*a* in FIG. 2 in exemplary fashion. The waveguide inner conductors 24*a*, 25*a*, and 26*a* and the waveguide outer conductors 23*a*, 24*b*, 25*b*, and 26*b* may be metallic PEC or PMC (EBG) as described below for possible waveguide mode options for the waveguides 23, 24, 25, and 26 of FIG. 2.

Figure 6:
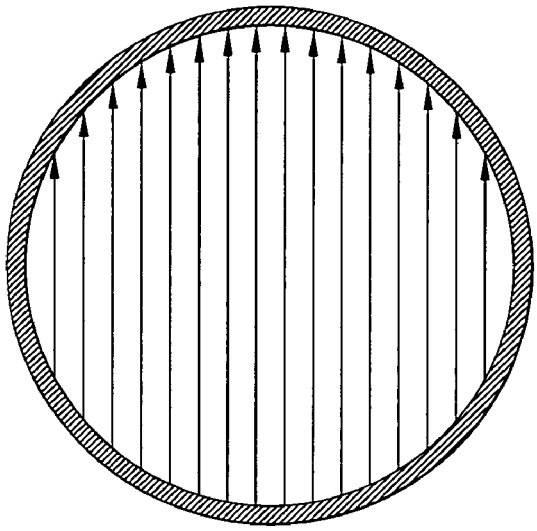
FIG. 6 is a diagram showing a TEM mode for a circular waveguide section.

I. A TEM mode for a circular waveguide section 23 with EBG surface outer conductor 23*a* as shown in FIG. 6.

II. A TEM mode for coaxial waveguide sections 24, 25, and 26 if the outer conductors (24*b*, 25*b*, and 26*b*) and inner conductors (24*a*, 25*a*, and 26*a*) are EBG surfaces. The field structure is similar to FIG. 6.

III. A circular waveguide-like $TE_{11}$, mode for coaxial waveguide sections 24, 25, and 26 whose outer conductors (24*b*, 25*b*, and 26*b*) are PEC and whose inner conductors (24*a*, 25*a*, and 26*a*) are PMC (EBG). This field structure is similar to that of FIG. 4.

Figure 7:
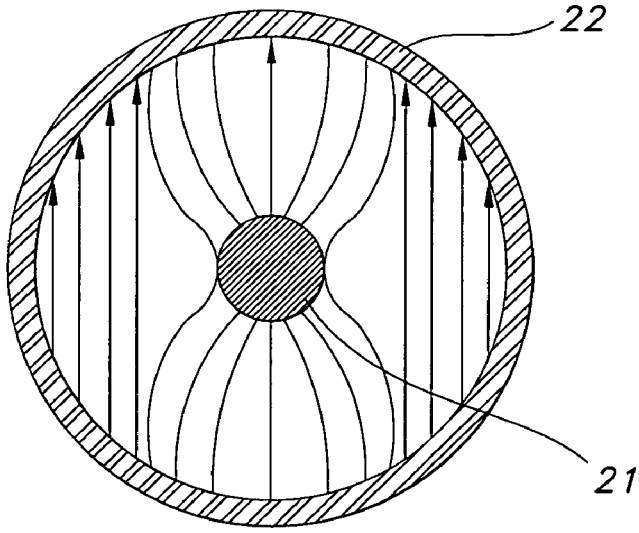
FIG. 7 shows a quasi-TEM waveguide mode for the case where an outer waveguide conductor is a perfect magnetic conductor and an inner conductor is a perfect electrical conductor.

IV. A quasi-TEM waveguide mode for coaxial waveguide sections 24, 25, and 26 whose outer conductors (24*b*, 25*b*, and 26*b*) are PMC (EBG) and inner conductors (24*a*, 25*a*, and 26*a*) are PEC 21 as shown in FIG. 7.

An EBG waveguide has the unique property that there is no frequency cutoff phenomenon within the frequency band of the EBG surface. This allows creating propagating modes independent of waveguide cross-sectional dimension, to a first order, for a given frequency band. It is therefore possible to create a $TE_{11}$ mode waveguide mode independent of cross section, as depicted in FIG. 4. It is well known in the art that these EBG electromagnetic hard surfaces operate over a 10–20% bandwidth, which is sufficient for multiband SATCOM applications.

Referring to FIG. 2, the dashed rings 23*a*, 24*a*, 25*a*, and 26*a* represent the EBG surface impedance at its resonant (high impedance) condition, which to a first order is a perfect magnetic conductor (PMC). Unlike a perfect electrical conductor (PEC), a PMC can sustain a tangential electric field. This allows a coaxial section of FIGS. 2 and 3 to sustain a TEM field pattern as shown in FIG. 6 when the inner and outer conductor coaxial EBG surfaces are resonant.

The solid black rings 24*b*, 25*b*, and 26*b* represent the EBG for the off-frequency, or out-of-band impedance that can be designed to operate as a PEC, i.e., a low impedance metallic surface. For purposes of explanation, consider the coaxial waveguide section 26 operating in band 4, as shown in FIGS. 2 and 3. When the coaxial waveguide 26 shown is operating within a frequency band in which the EBG inner conductor 26*a* is resonant (dashed black), and the outer conductor 26*b* is PEC (solid black), the waveguide 26 can sustain a metallic circular waveguide $TE_{11}$ mode of FIG. 4 (mode option number III above) in spite of the fact that concentric rings are present within the waveguide interior. When the EBG inner conductor 26*a* is out-of-band, the waveguide operates in the coaxial $TE_{11}$, mode, with its commensurate cutoff frequency.

The fundamental mode of the all-metallic coaxial structure is the transverse electromagnetic (TEM) mode, which is deliberately not excited for this application. The first higher ordered metallic coaxial waveguide modes are again described by Equation 2. Similar expressions can be derived for different a/b ratios. In addition, cutoff frequencies can be readily predicted with contemporary EM computer simulations tools.

If the band 4 coaxial section 26 has resonant EBG surfaces on the inner conductor 26*a* and outer conductor 26*b* (dashed black), a TEM (mode number II above) exists as shown in FIG. 6. If the band 4 coaxial section 26 has a resonant PEC surface on the inner conductor 26*a* (solid black) and a PMC surface on the outer conductor 26*b* (dashed black), then a quasi-TEM mode (mode IV above) exists as shown in FIG. 7.

With the second embodiment, modes can be mixed and matched across the separate frequency bands (feed sections). For example, in a circular waveguide a TEM mode produces high aperture efficiency and lower cross polarization but at the expense of higher side lobe levels. In contrast, the $TE_{11}$ mode gives lower side lobes levels at the expense of lower aperture efficiency and lower gain.

The second embodiment provides the ability to optimally adjust the radiation pattern for each frequency band for proper reflector surface illumination by means of EBG-based waveguide surfaces since there is no constraint of waveguide cutoff as long as the EBG sections are resonant to the PMC boundary condition.

With the second embodiment dual-band operation within each individual feed waveguide section is implemented by combining all metallic waveguide modes with EBG waveguide modes, each operating in different frequency bands. In the second embodiment, an EBG surfaces on an outer conductor sets the lower frequency region and an EBG surface on an inner conductor sets the higher frequency region of a given waveguide feed concentric cross section. When the EBG surface is resonant to the PMC condition, the all-metallic waveguide cutoff phenomenon does not exist. When the EBG is out-of-band, it can be designed to function as a PEC at a higher frequency region to sustain the all-metallic waveguide mode. This concept is equally applicable to a circular $TE_{11}$ waveguide and coaxial waveguide cross sections. As an example, consider the 29- to 31-GHz coaxial $TE_{11}$ ring shown in Table 1. Its cutoff frequency is 5.5 GHz for the all-metallic coaxial waveguide TE11 mode. An EBG surface can be designed to be resonant to 3.0 GHz, but be a PEC at 5.5 GHz. This will realize a second operating band centered at 3.0 GHz that would be normally cutoff in the all-metallic coaxial waveguide mode.

A coaxial multiband waveguide feed 20, as shown in FIG. 2, is attractive since it enables a convenient method to integrate low-noise amplifiers, power amplifiers, or transmit/receive modules directly to the feed 20 to minimize transmission line loss between the feed 20 and transceiver active elements (not shown). It is also possible to have a waveguide input to each concentric ring section.

Since the resonant EBG waveguide mode mimics the field structure of the all metallic $TE_{11}$ circular waveguide mode, circular polarization can be realized by the superposition of two spatially orthogonal modes electrically shifted in phase by 90°, as in the case of the all metallic $TE_{11}$ circular waveguide. It is possible to realize dual orthogonal linear polarization, right-hand circularly polarized (RHCP) and left-hand circularly polarized (LHCP), and arbitrarily orientated linear polarization with an appropriate phasing network (not shown).

The EBG surfaces described herein can be realized at least three ways: a striped EBG microstrip circuit surface in flexible printed wiring board that can be formed to be conformal with, and bonded to the cylindrical waveguide surfaces; air filled longitudinal corrugations may be placed on the waveguide inside wall; and dielectrically loaded longitudinal corrugations may be placed on the waveguide inside wall to create an electromagnetic hard surface. Other embodiments apply to the same general principals.

The discussion thus far centered on concentric circular waveguide cross sections, but the concept is equally applicable to other symmetric waveguide cross sections such as square, rectangular, triangular, etc. The concentric waveguide concepts described herein are applicable to structures with one or more planes of symmetry.

It is believed that the multiband waveguide reflector antenna feed of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A multiband waveguide reflector antenna feed comprising a plurality of circular waveguide feeds disposed in a concentric architecture said plurality of waveguide feeds comprising:

a band 1 waveguide feed disposed in a center of the multiband waveguide reflector antenna feed;

a band 2 waveguide feed disposed in a concentric ring around the band 1 waveguide feed and operating as a coaxial waveguide with an outer surface of the band 1 waveguide feed as a band 2 inner conductor;

a band 3 waveguide feed disposed in a concentric ring around the band 2 waveguide feed and operating as a coaxial waveguide with an outer surface of the band 2 waveguide feed as a band 3 inner conductor; and a band 4 waveguide feed disposed in a concentric around the band 3 waveguide feed and operating as a coaxial waveguide feed with an outer surface of the band 3 waveguide feed as a band 4 inner conductor.

2. The multiband waveguide reflector antenna feed of claim 1 wherein the plurality of circular waveguide feeds comprises all-metallic waveguides.

3. The multiband waveguide reflector antenna feed of claim 2 wherein the all-metallic waveguides comprise approximations of perfect electrical conductor (PEC) surfaces.

4. The multiband waveguide reflector antenna feed of claim 2 wherein the band 1 waveguide feed operates in a $TE_{11}$ mode.

5. The multiband waveguide reflector antenna feed of claim 2 wherein the band 2, 3, and 4 waveguide feeds operate in a coaxial $TE_{11}$ mode.

6. The multiband waveguide reflector antenna feed of claim 1 wherein one or more of the plurality of circular waveguide feeds comprises electromagnetic band gap (EBG) waveguide surfaces.

7. The multiband waveguide reflector antenna feed of claim 6 wherein the band 1 waveguide feed comprises an EBG surface on a band 1 outer conductor and operates in a circular waveguide TEM mode.

8. The multiband waveguide reflector antenna feed of claim 6 wherein the band 2 waveguide feed, the band 3 waveguide feed, and the band 4 waveguide feed comprise EBG surfaces on band 2, band 3, and band 4 inner and outer conductors and operate in a circular waveguide TEM mode.

9. The multiband waveguide reflector antenna feed of claim 6 wherein the band 2 waveguide feed, the band 3 waveguide feed, or the band 4 waveguide feed comprise band 2, band 3, and band 4 outer conductors that approximate perfect electrical conductor (PEC) and band 2, band 3, and band 4 inner conductors with EBG surfaces and operate in a circular waveguide-like $TE_{11}$ mode.

10. The multiband waveguide reflector antenna feed of claim 6 wherein the band 2 waveguide feed, the band 3 waveguide feed, or the band 4 waveguide feed comprise EBG surface band 2, band 3, and band 4 outer conductors and band 2, band 3, and band 4 inner conductors that approximate perfect electrical conductor (PEC) and operate in a quasi-TEM waveguide mode.

11. A multiband waveguide reflector antenna feed comprising a plurality of waveguide feeds disposed in a concentric architecture said plurality of waveguide feeds comprising:

a center waveguide feed disposed in a center of the multiband waveguide reflector antenna feed; and one or more coaxial waveguide feeds disposed around the center waveguide feed wherein an adjacent inner waveguide feed to the one or more coaxial waveguide feed acts as an inner conductor for the one or more coaxial waveguide feeds;

wherein one or more of the plurality of waveguide feeds comprise electromagnetic band gap (EBG) surfaces on inner conductor waveguide surfaces.

12. The multiband waveguide reflector antenna feed of claim 11 wherein one or more of the plurality of waveguide feeds comprises all-metallic waveguides.

13. The multiband waveguide reflector antenna feed of claim 12 wherein the all-metallic waveguides comprise approximations of perfect electrical conductor (PEC) surfaces.

14. The multiband waveguide reflector antenna feed of claim 12 wherein the center waveguide feed operates in a $TE_{11}$ mode.

15. The multiband waveguide reflector antenna feed of claim 12 wherein the one or more coaxial waveguide feeds operate in a coaxial $TE_{11}$ mode.

16. The multiband waveguide reflector antenna feed of claim 11 wherein the center waveguide feed comprises an EBG outer conductor and operates in a circular waveguide TEM mode.

17. The multiband waveguide reflector antenna feed of claim 11 wherein one or more of the coaxial waveguide feeds comprise EBG inner conductors and outer conductors and operate in a circular waveguide TEM mode.

18. The multiband waveguide reflector antenna feed of claim 11 wherein one or more of the coaxial waveguide feeds comprise EBG inner conductors and PEC outer conductors and operate in a circular waveguide-like $TE_{11}$ mode.

19. The multiband waveguide reflector antenna feed of claim 11 wherein one or more of the coaxial waveguide feeds comprise EBG outer conductors and PEC inner conductors and operate in a quasi-TEM waveguide mode.

* * * * *